US007772973B2

(12) United States Patent
Shih

(10) Patent No.: US 7,772,973 B2
(45) Date of Patent: Aug. 10, 2010

(54) BURGLARPROOF PURSE

(76) Inventor: Tsang-Chu Shih, No. 67-11, Haojin Rd., Puyan Township, Changhua County 516 (TW)

( * ) Notice: Subject to any disclaimer, the term of this patent is extended or adjusted under 35 U.S.C. 154(b) by 249 days.

(21) Appl. No.: 11/923,778

(22) Filed: Oct. 25, 2007

(65) Prior Publication Data

US 2009/0109029 A1 Apr. 30, 2009

(51) Int. Cl.
*G08B 13/14* (2006.01)

(52) U.S. Cl. ..... 340/568.7; 340/652; 150/101

(58) Field of Classification Search ..... 340/568.7, 340/652; 150/101
See application file for complete search history.

(56) References Cited

U.S. PATENT DOCUMENTS 2,534,783 A * 12/1950 Marogg ..... 150/101
3,851,326 A * 11/1974 Costa ..... 340/571
7,064,667 B2 * 6/2006 Sosna ..... 340/568.7
7,088,257 B2 * 8/2006 Weekes ..... 340/652

* cited by examiner

*Primary Examiner*—George A Bugg
(74) *Attorney, Agent, or Firm*—Rabin & Berdo, P.C.

(57) ABSTRACT

A burglarproof purse installs a control switch and an alarm for issuing a warning sound at hidden positions of the purse, and a closed and opened loop is distributed all over each surface of the purse and connected to the control switch and the alarm, such that after a user turns on the control switch, the closed and opened loop will be disconnected whenever the purse is opened or any surface of the purse is damaged, and a warning sound is produced to alert the abnormal situation and scare away the thief who tries to open the purse illegally.

1 Claim, 9 Drawing Sheets

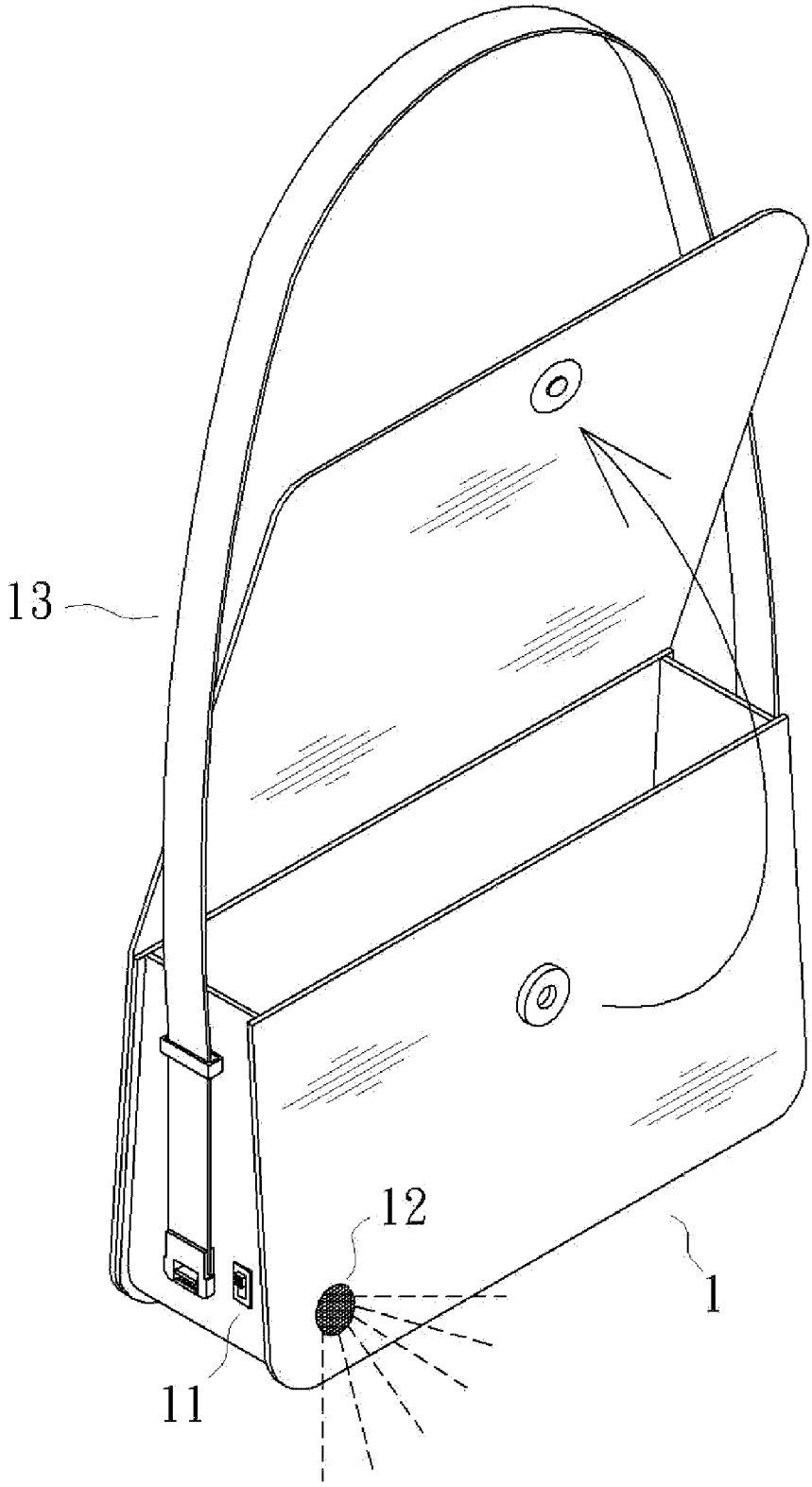
FIG. 4-A

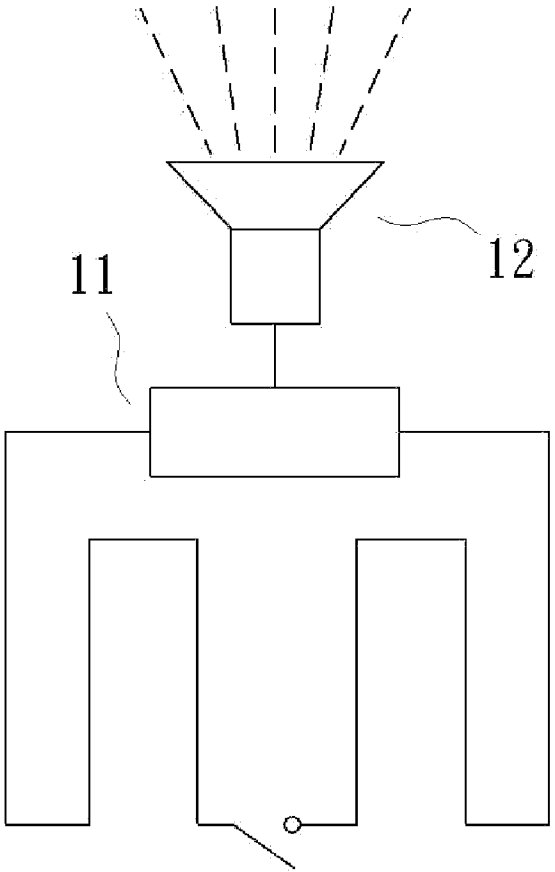
FIG. 4-B

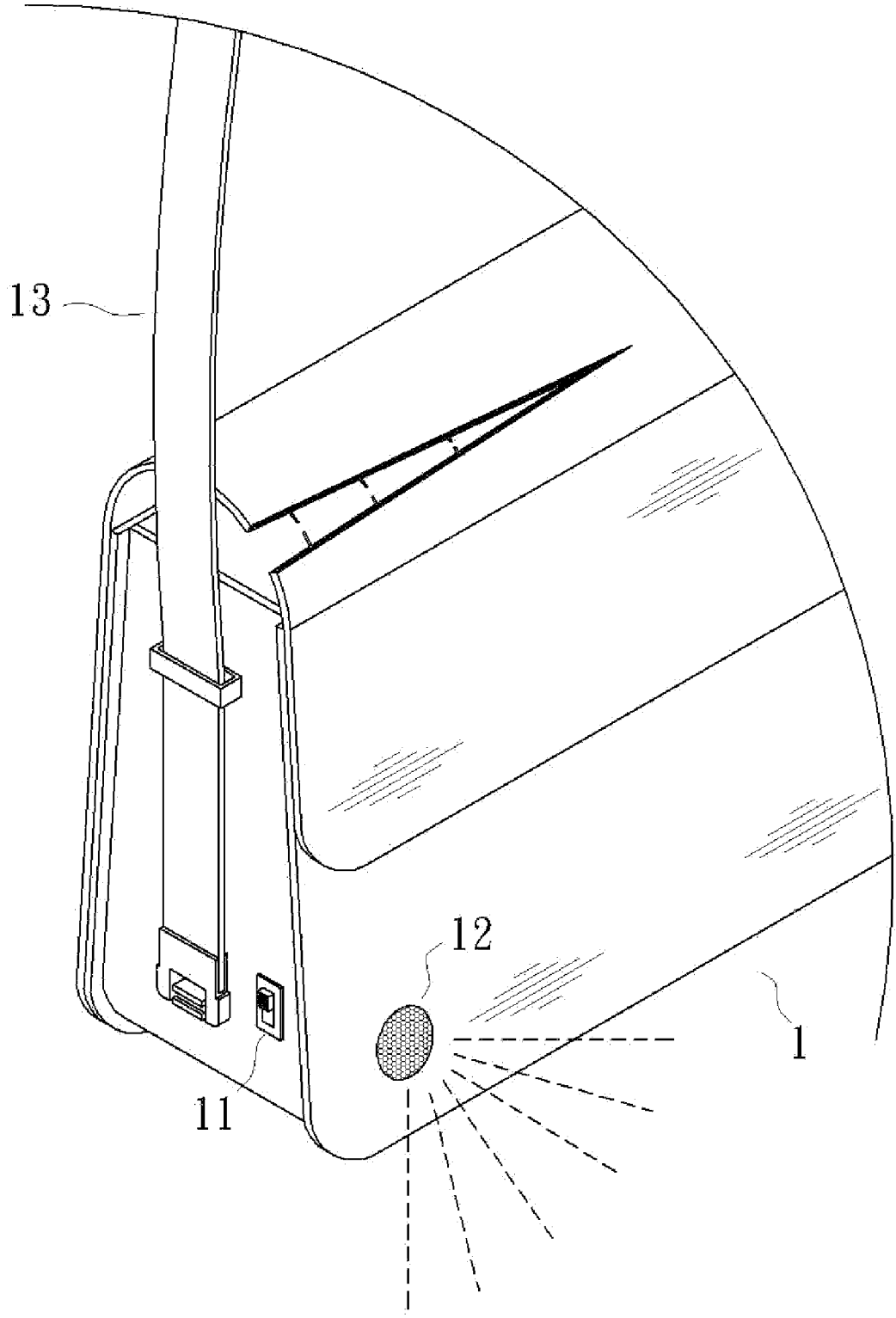
FIG. 5-A

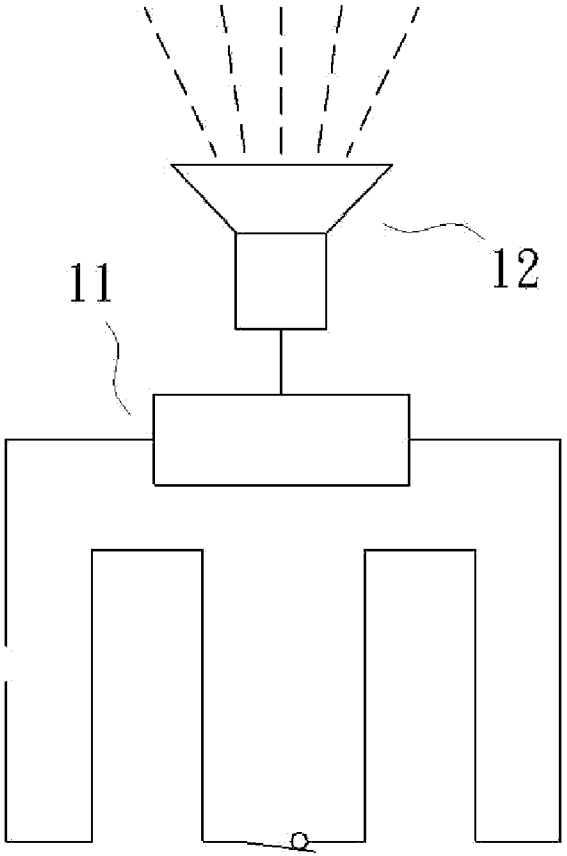
FIG. 5-B

BURGLARPROOF PURSE

BACKGROUND OF THE INVENTION

1. Field of the Invention

The present invention relates to a burglarproof purse, and more particularly to a purse capable of issuing a sound to alert a user about the surrounding whenever the purse is opened or any surface of the purse is damaged, after the user turns on a control switch, so as to achieve the effect of scaring unauthorized person away from opening the purse.

2. Description of the Related Art

In general, most alarms installed in a lady's purse for issuing a warning sound whenever a thief illegally opens the purse in order to achieve the effect of scaring away the thief, but the effect of this method is limited because the thief also knows that there is an alarm in the purse, and thus the thief may cut the purse to take away the purse owner's belongings. The installed alarm no long has its original expected effect.

SUMMARY OF THE INVENTION

In view of the aforementioned shortcoming of the prior art, the applicant of the present invention developed a burglarproof purse that installs a control switch and an alarm for issuing a warning sound at hidden positions of the purse, and a closed and opened loop is distributed over all positions of each surface of the purse and connected to the control switch and the alarm, such that after users turn on the control switch, the closed and opened loop will be disconnected whenever the purse is opened or any surface of the purse is damaged, and a warning sound is produced to alert the situation and scare away the thief who tries to open the purse illegally.

Therefore, it is an objective of the present invention to provide a burglarproof purse, wherein the control switch is controlled by a remote controller.

Another objective of the invention is to provide a burglarproof purse, wherein the alarm is combined with the purse in different forms to achieve the hidden purpose as well as the aesthetic appearance.

Another objective of the invention is to provide a burglarproof purse, wherein alarm is combined with the purse in different forms to achieve both effects of hiding the alarm and preventing the alarm from being damaged.

Another objective of the invention is to provide a burglarproof purse, wherein the closed and opened loop can be installed and combined with the purse in any way to match different styles of the purse.

Another objective of the invention is to provide a burglarproof purse, wherein a circuit is connected to the position of a zipper in the purse, so that the warning sound can be issued to alert abnormal situation and scare away the thief who tries to open the purse.

Another objective of the invention is to provide a burglarproof purse, wherein the closed and opened loop can be applied in the hand-carrying and shoulder straps of the purse, so as to prevent the purse from being robbed.

BRIEF DESCRIPTION OF THE DRAWINGS

FIG. 4A is a schematic view of a preferred embodiment of the present invention;

FIG. 4B is a schematic view of a circuit in accordance with a preferred embodiment of the present invention;

FIG. 5A is another schematic view of a preferred embodiment of the present invention;

FIG. 5B is another schematic view of a circuit in accordance with a preferred embodiment of the present invention;

DETAILED DESCRIPTION OF THE PREFERRED EMBODIMENTS

Figure 1:
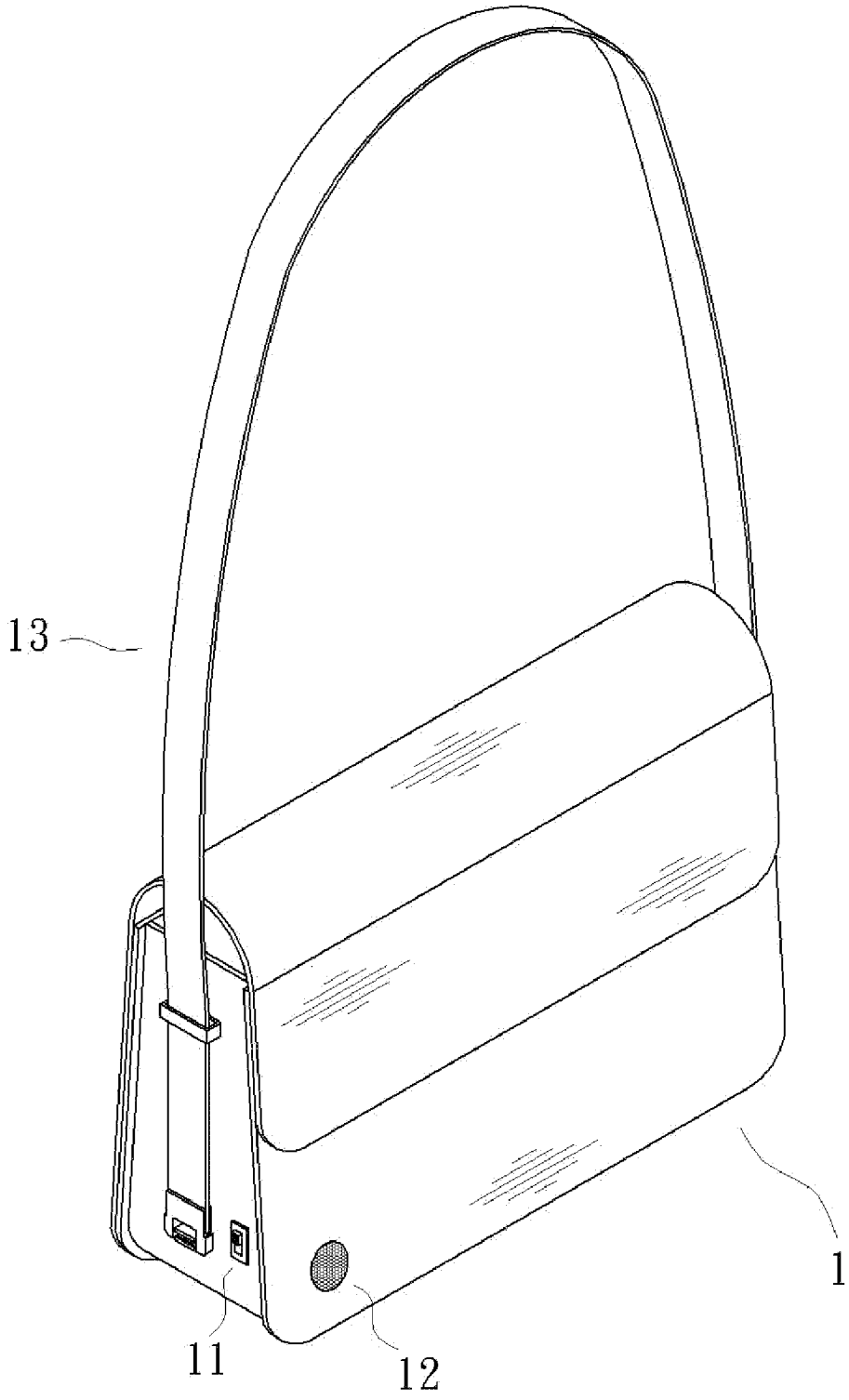
FIG. 1 is a perspective view of a burglarproof purse in accordance with the present invention.
Figure 2:
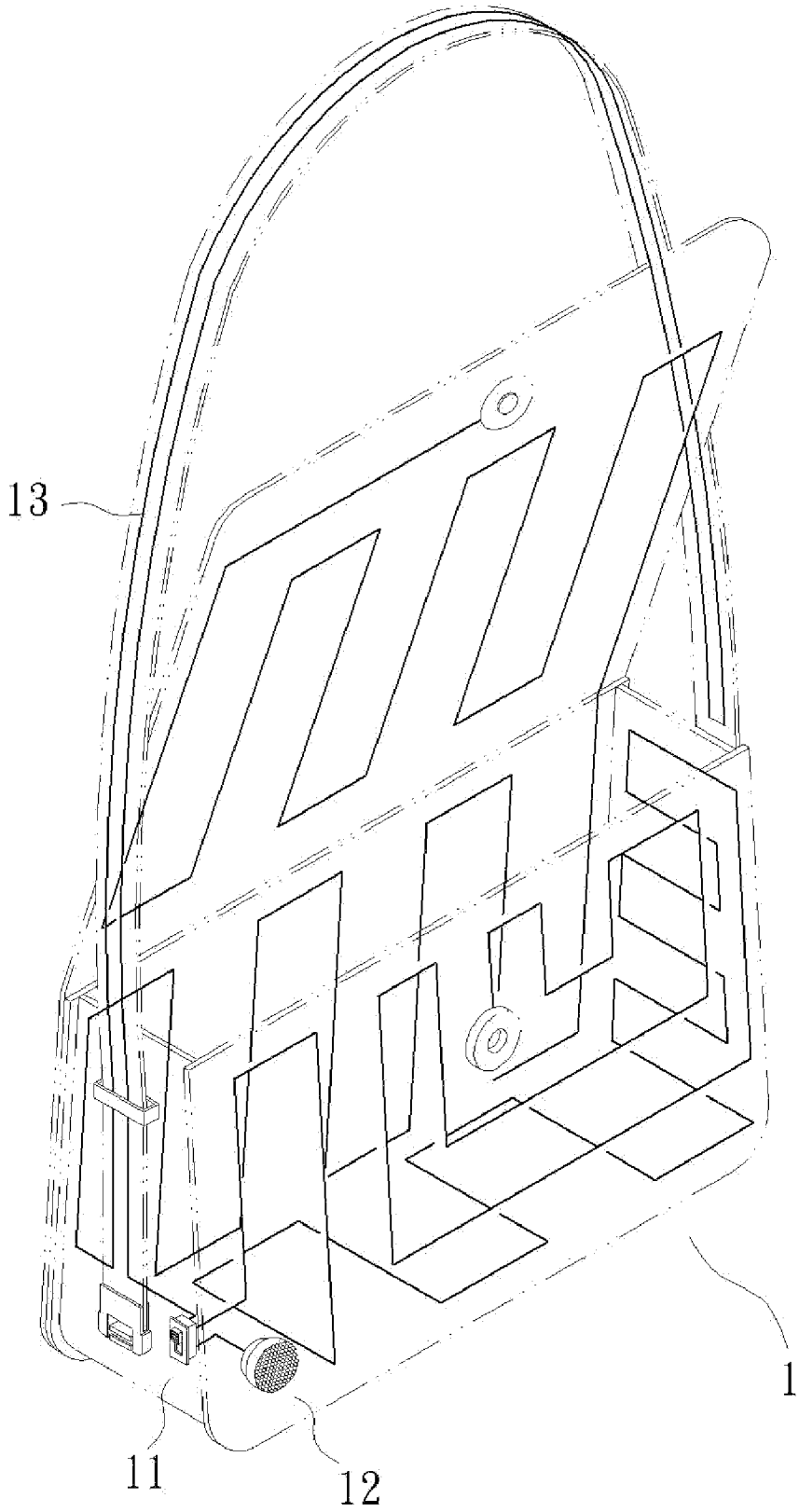
FIG. 2 is another perspective view of a burglarproof purse in accordance with the present invention.
Figure 3:
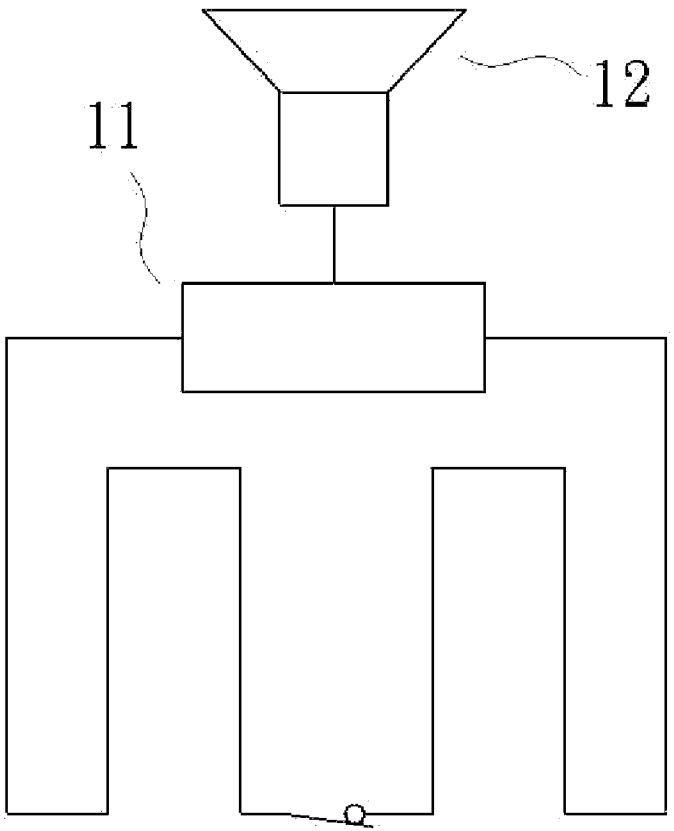
FIG. 3 is a schematic view of a circuit connected in series in accordance with the present invention.

Referring to FIGS. 1 to 3 for a burglarproof purse in accordance with the present invention, the burglarproof purse 1 comprises a control switch 11 and an alarm 12 for issuing a sound at hidden positions (such as the edges or corners) of the purse 1, and a closed and opened loop distributed all over the purse 1 and connected with the control switch 11 and the alarm 12, such that after a user turns on the control switch 11, the closed and opened loop will be disconnected (as shown in FIGS. 4A and 4B) whenever the purse is opened by a person other than the owner of the purse 1, and a sound will be issued to alert the situation and scare away the thief who tries to open the purse illegally. If the purse is not opened from the front side, but any side of the purse 1 is damaged by a tool (as shown in FIGS. 5A and 5B), the closed and opened loop will be disconnected to issue a sound to alert the situation immediately and achieve the effect of scaring away the thief.

In the meantime, the loop is applied and connected to the position of a zipper in the purse 1 for providing the alarm effect by issuing a sound to alert the situation and scare away the thief who tries to open the purse illegally.

In addition to the effect of scaring away the thief, the control switch 11 can be controlled by a remote controller, and the alarm 12 can be combined with the purse 1 in any form to achieve the effect of hiding the control switch 11 and maintain the aesthetic appearance of the purse 1. The positions of the control switch 11 cannot be found easily, and the purse 1 is prevented from being damaged easily. The closed and opened loop can be applied to a hand-carrying or shoulder strap 13 of the purse 1, such that a warning sound will be issued if the strap 13 is pulled, so as to achieve the effect of preventing the purse from being robbed.

Figure 6:
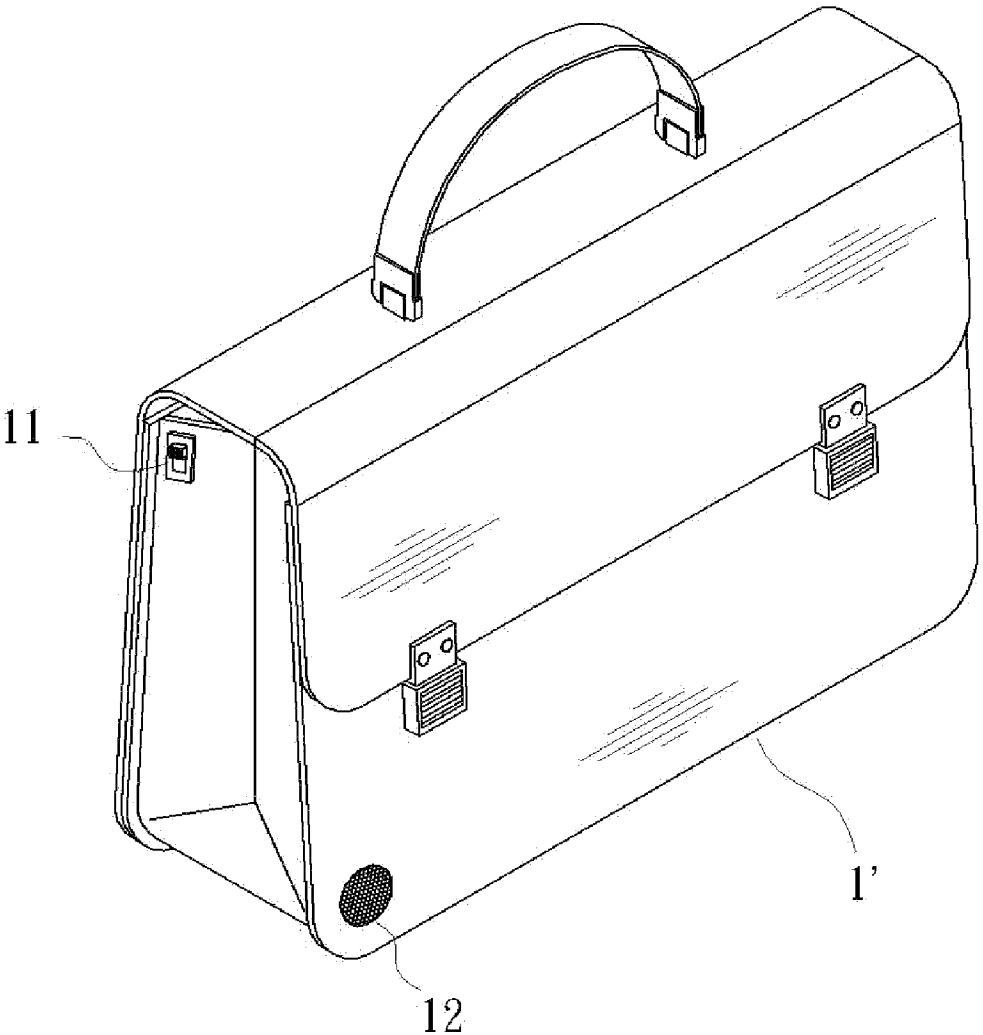
FIG. 6 is a perspective view of another burglarproof purse.
Figure 7:
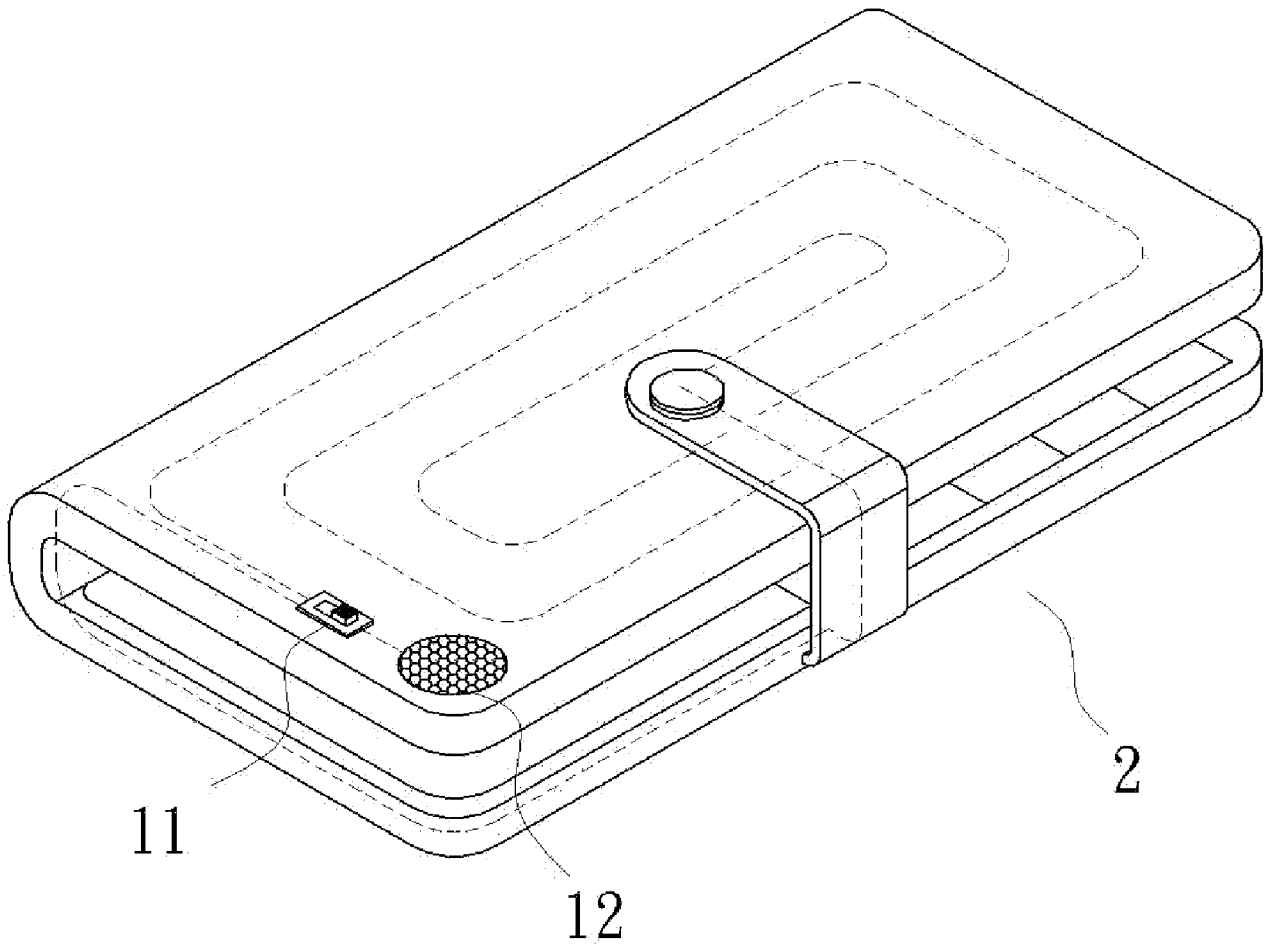
FIG. 7 is another perspective view of another burglarproof purse.

Of course, the closed and opened loop can be installed to a different purse 1' (as shown in FIG. 6) or a purse 2 (as shown in FIG. 7) in different ways as well.

In summation of the description above, the invention is definitely in compliance with the requirements of patent application, and thus duly filed for patent application.

What is claimed is:

1. A theft deterrent purse, comprising a control switch and an alarm for issuing a sound installed at hidden positions of the purse, and a closed and opened loop distributed over all surfaces of the purse and at positions of a strap to connect with the control switch and the alarm, such that after a user turns on the control switch, the closed and opened loop will be disconnected whenever the purse is opened or any surface of the purse is damaged, so as to issue a warning sound to alert both the user and a thief of an attempted theft condition.

* * * * *